US006978723B2

(12) United States Patent
Dodd

(10) Patent No.: US 6,978,723 B2
(45) Date of Patent: Dec. 27, 2005

(54) MODULAR PICNIC TABLE

(76) Inventor: Dolphus A. Dodd, 230 Champion Hill Dr., Jackson, MS (US) 39212

( * ) Notice: Subject to any disclaimer, the term of this patent is extended or adjusted under 35 U.S.C. 154(b) by 360 days.

(21) Appl. No.: 10/425,105

(22) Filed: Apr. 29, 2003

(65) Prior Publication Data

US 2003/0230223 A1 Dec. 18, 2003

Related U.S. Application Data

(63) Continuation-in-part of application No. 09/769,319, filed on Jan. 25, 2001, now abandoned.

(51) Int. Cl.[7] ..... A47B 13/00
(52) U.S. Cl. ..... 108/153.1; 297/158.3
(58) Field of Search ..... 108/153.1, 157.18, 108/158.12, 157.14, 180, 186; 297/158.5, 297/157.1, 158.3

(56) References Cited

U.S. PATENT DOCUMENTS 3,189,379 A * 6/1965 Potter ..... 297/158.5
3,262,734 A * 7/1966 Kuks ..... 297/158.3
4,572,574 A * 2/1986 Fischhaber et al. ..... 297/158.4
5,644,995 A * 7/1997 Gurwell et al. ..... 108/188
5,720,512 A * 2/1998 Hostetler ..... 297/158.5
6,042,179 A * 3/2000 Wallace, III ..... 297/158.4
D474,900 S * 5/2003 Underbrink ..... D6/310

* cited by examiner

*Primary Examiner*—Jose V. Chen
(74) *Attorney, Agent, or Firm*—John D. Gugliotta; Olen L. York, III

(57) ABSTRACT

A picnic table system is provided that is modular in design for ease of storage out of inclement weather when not in use. A bench assembly sits atop two pedestal-type legs and the table top and is supported by the upper portion of the pedestal legs. Both the top and the benches are secured by frictional impingement. When the structure is to be moved, the bench assembly, table top and the two pedestal legs are stored in a manner conserving floor or storage space. The ability to store the structure inside during inclement weather or during off season allows for increased life of the structure, thus saving the user replacement or repair costs as well.

15 Claims, 9 Drawing Sheets

MODULAR PICNIC TABLE

RELATED APPLICATIONS

The present application is a Continuation-in-Part of U.S. patent applicaiton Ser. No. 09/769,319, filed on Jan. 25, 2001, hereinafter abandoned.

BACKGROUND OF THE INVENTION

1. Field of the Invention

The present invention relates generally to a table having separable components and, more particularly, to a system having separable, assembled components that form a table and benches.

2. Description of the Related Art

In the related art, picnic tables can be found in backyards, parks and campgrounds, and rest stops across the country. While most commonly used as an eating table, it is also pressed into service as a food preparation table, a work surface, a meeting table or the like. While the picnic table is certainly useful and versatile, it does suffer from the drawback that it is stored outside at all times, thus it is subjected to the sun's rays, rain, wind, and other inclement weather or harmful environmental conditions and/or elements. For those areas with a severe winter season, they are also subjected to snow and reduced temperatures. This extreme weather can induce damage and leads to increased repair costs or more frequent replacement costs. Those lucky enough to have a large garage or storage shed can store them inside during the off-season winter months thus extending its life. However, this takes a great deal of storage area due to the large footprint and volume occupied by an assembled picnic table.

A search of the prior art did not disclose any patents that read directly on the claims of the instant invention; however, the following references were considered related.

Of particular interest is U.S. Pat. No. 6,042,179, issued in the name of Wallace, III, which discloses a table and bench assembly moveable between a folded position and an unfolded position. Wallace, III discloses a table that is lockably secured and released via a ball-handle and a rod, allowing the device to foldably collapse into a single unit. However, Wallace, III suffers from several drawbacks, including the number of movable parts necessary to assemble and disassemble the apparatus. Furthermore, the collapse of the table into a single unit is not ideal for storage and or transportation, especially if storage space is limited.

Consequently, there is a need for a means by which the functionality of a picnic table can be provided in a small package for ease of assembly and disassembly, use and storage, thus addressing the shortcomings of conventional picnic tables as described above.

SUMMARY OF THE INVENTION

It is therefore an object of the present invention to provide an improved modular picnic table system.

It is a feature of the present invention to provide an improved modular picnic table system having separable, assembled components that form a table top, parallel benches and supportable pedestal base elements.

Briefly described according to one embodiment of the present invention, a picnic table system is provided that is modular in design for ease of storage out of inclement weather when not in use. The bench assembly sits atop two pedestal-type legs and the table top is supported by the upper portion of the pedestal legs. Both the table top and the benches are frictionally impinged to securely maintain the structural integrity of the assembled components. When the invention is to be moved, stored for the season, or otherwise not needed, the frictional impingement is removed and the resultant four pieces, namely the top, the bench assembly, and the two pedestal legs, may be stored in a manner conserving floor or storage space. The ability to store the invention inside during inclement weather or during off season allows for increased life of the invention, thus saving the user replacement or repair costs as well.

The use of a modular picnic table of the present design provides a firm, stable picnic table area that can be easily disassembled and assembled in a manner which is quick, easy and efficient.

Advantages of the collapsible design of the present invention, having separate individual pieces held together with pegs, allows for easily assembled and disassembled with no tools needed.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1A:
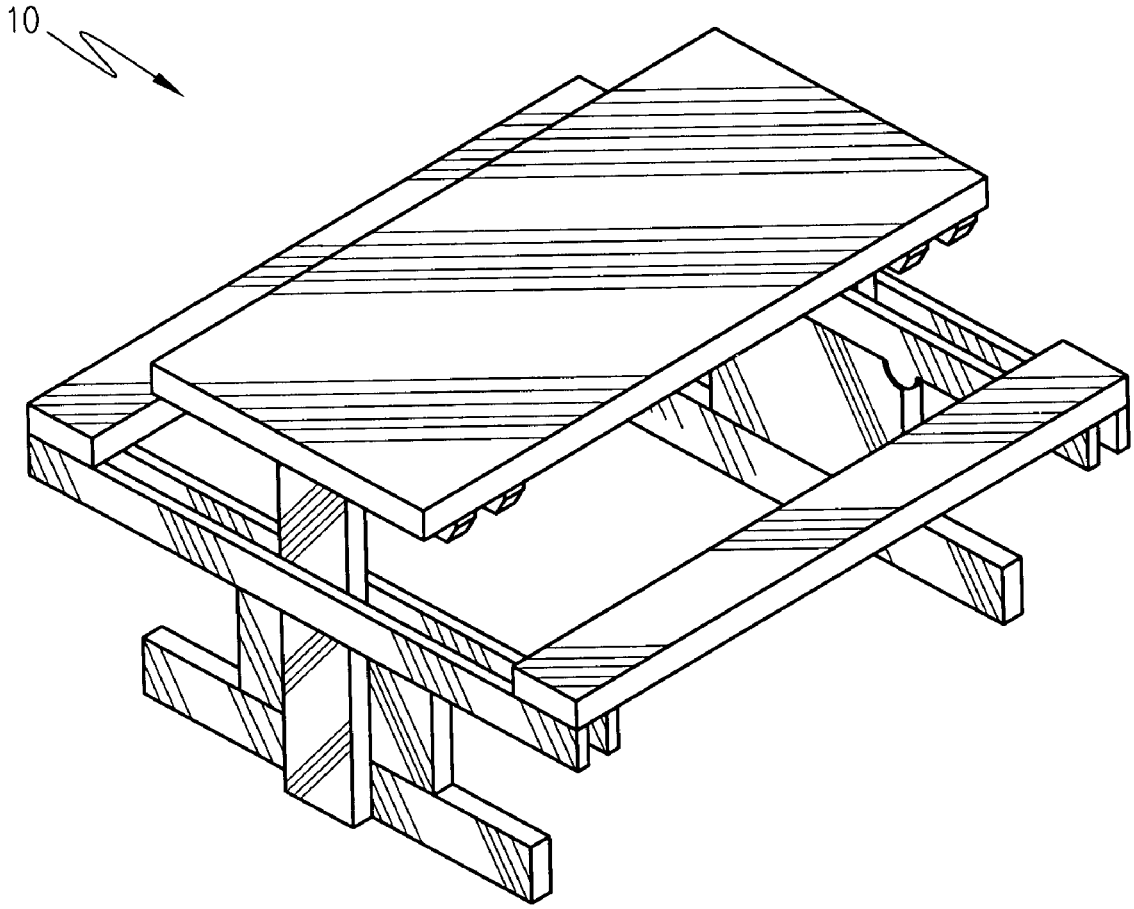
FIG. 1*a* is a perspective view of a modular picnic table according to the preferred embodiment of the present invention.
Figure 1B:
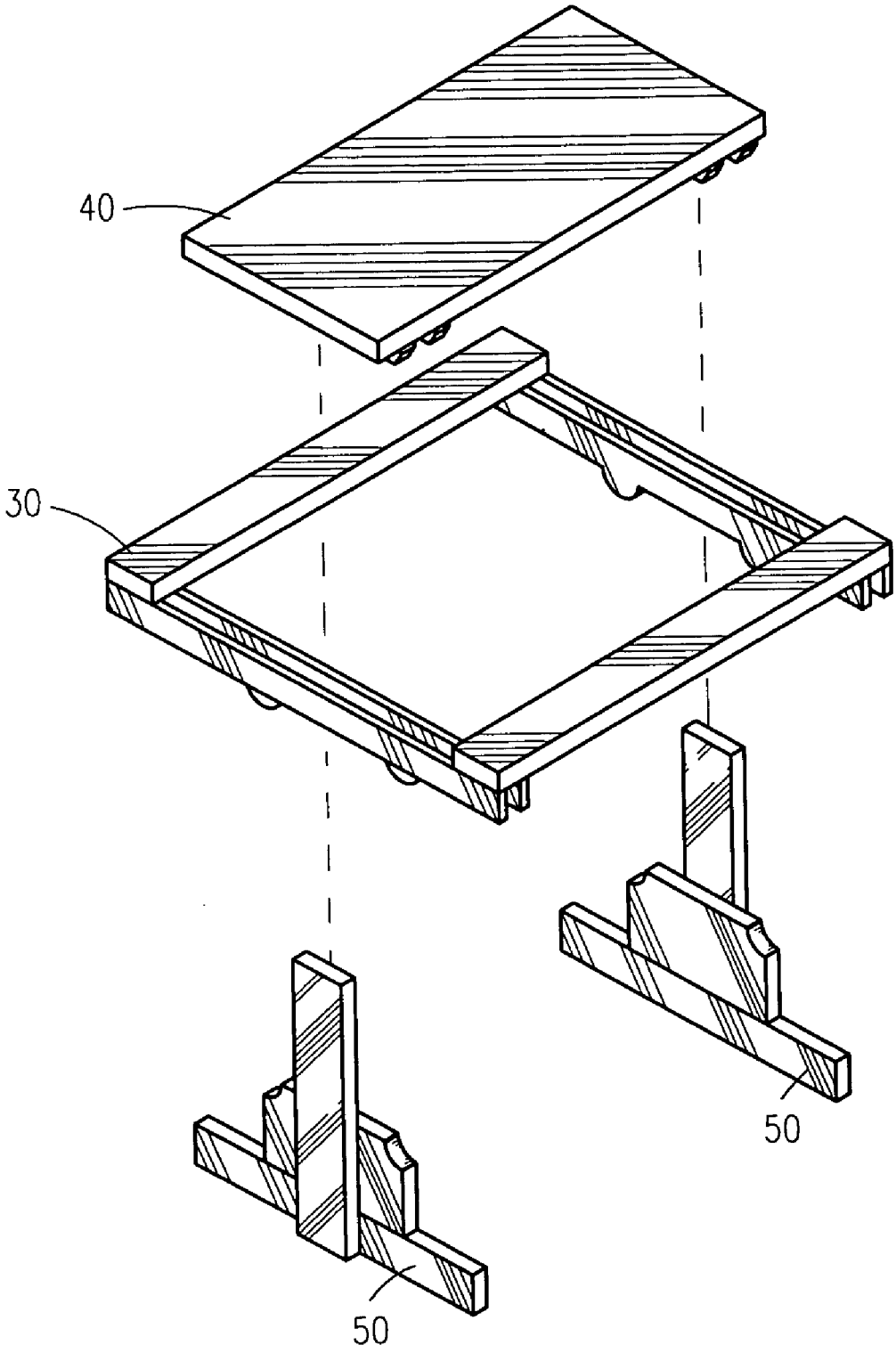
FIG. 1*b* is an exploded perspective view thereof.

The best mode for carrying out the invention is presented in terms of its preferred embodiment, herein depicted within the Figures.

1. Detailed Description of the Figures

Referring now to FIG. 1*a* through FIG. 5*b,* a modular picnic table 10 is shown, according to a preferred embodiment of the present invention, comprising a collapsible design of separate individual pieces held together through frictional fit impingement and/or by pin fasteners 20, thereby allowing for easy assembly and disassembly without the need for specialized tools. A bench element 30 rests on and is supported by a pair of individually supported pedestal base elements 50. A table top 40 rests atop the pair of pedestal base elements 50 as well. The four-unit components (bench, pair of base elements and table top, respectively) are held in place by the use of frictional fit impingement or pin fasteners.

Figure 2:
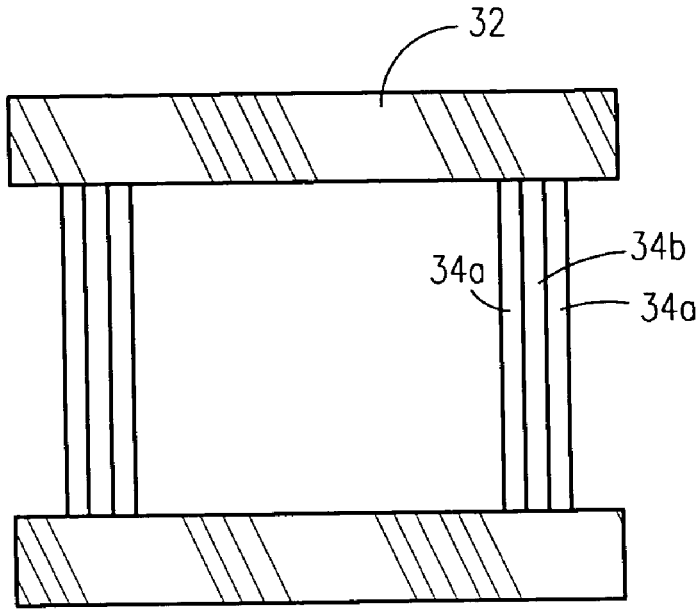
FIG. 2 is a top plan view of a dual cantilever bench element 30 for use with the modular picnic table.

FIG. 2 shows the bench element 30 in greater detail, herein envisioned as a unitary element and further described as a dual cantilevered bench element (a cantilevered element is balanced by counter-forces across a fulcrum, and because users may set on both bench slats 32, there is counter-acting forces for both slats 32, resulting in a dual cantilever action). As shown, a pair of lateral bench slats 32 are mounted parallel to each other and held together in a spaced-apart (offset) manner by a plurality of support stringer assemblies 34 (shown in FIG. 3 as a pair of support stringer assemblies). Each support stringer assembly 34 is formed of a pair of individual support stringer members 34*a* separated by a pedestal receiving slot 34*b*. At least one of each pair of individual support stringer members 34*a* (e.g., one member 34*a* on each end of the bench element 30) includes a contoured underside 36 that frictionally impinges with a correspondingly shaped pedestal base element 50. It is envisioned that each individual support stringer member 34*a* comprising the pair of members 34 may be provided with the contoured underside 36 to provide further structural stability to the modular picnic table 10. The contoured underside 36 is envisioned as including a variety of combinations (including key-lock, jigsaw formations or otherwise frictionally interlocking combinations) with FIG. 4 serving as a representative model. As shown in FIG. 4, the contoured underside includes a pair of curvilinear protuberances 36*a,* formed along the support stringer assemblies 34, corresponding to curvilinear indentations 56*a* formed in the bench supporting element 56 (described below) in the pedestal base 50. The protuberances 36*a* frictionally and gravitationally impinge within the indentations 56*a,* thereby providing structural support to the bench element 30 during use.

Figure 3:
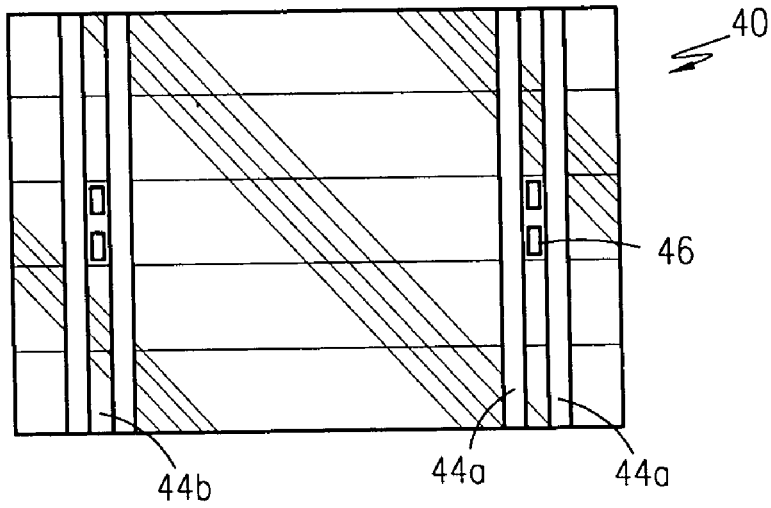
FIG. 3 is a plan view of the underside of the table top 40 illustrating the stringer members 44*a* and pedestal receiving slot 44*b,* and the rib receiving orifices 46 therein.
Figure 4:
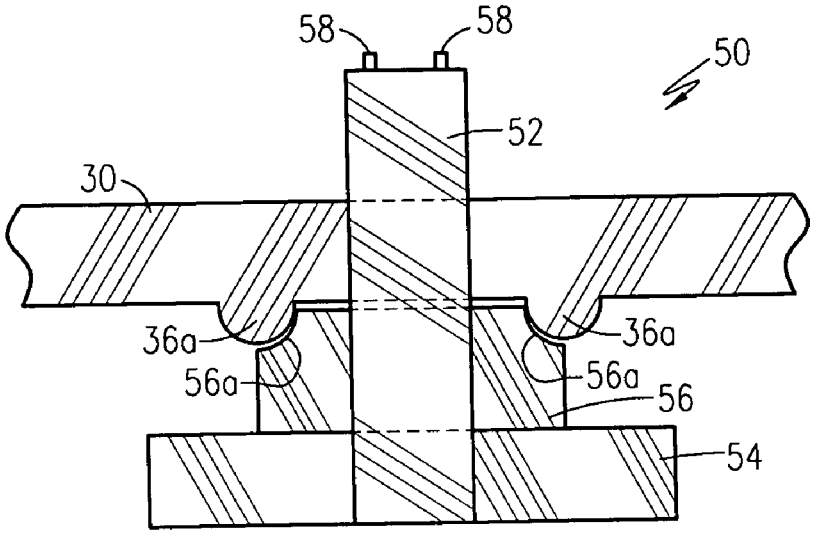
FIG. 4 is an elevational view of a pedestal base element 50 comprising rounded (curvilinear) indentations 56*a* for receiving rounded protuberances 36*a* from the underside of the bench element 30 for frictional fit impingement thereon.

FIG. 3 show the table top 40 in greater detail. As shown, the table top 40 has a generally planar upper surface 42. Attached to the lower surface of the table top 40 are a plurality of attachment stringer assemblies 44. A pair of attachment stringer assemblies 44 are mounted parallel to, but on opposing ends, of each other. Each attachment stringer assembly 44 is formed of a pair of individual attachment stringer members 44*a* forming a pedestal receiving slot 44*b* therebetween. It is anticipated that the overall size and dimension and location of these support stringer members 44*a* separated by a pedestal receiving slot 44*b* would be comparable to the support stringer assemblies 34 of the bench element 30, so as to substantially align the support stringer assemblies 34 and the attachment stringer assemblies 44 when the modular picnic table 10 is assembled. Between the individual attachment stringer members 44*a* (corresponding to the pedestal receiving slot 44*b*), a plurality of rib receiving orifices 46 are provided for frictionally and gravitationally impinging a plurality of ribs 58 provided along the top supporting surface 53 of pedestal base element 50.

Figure 5A:
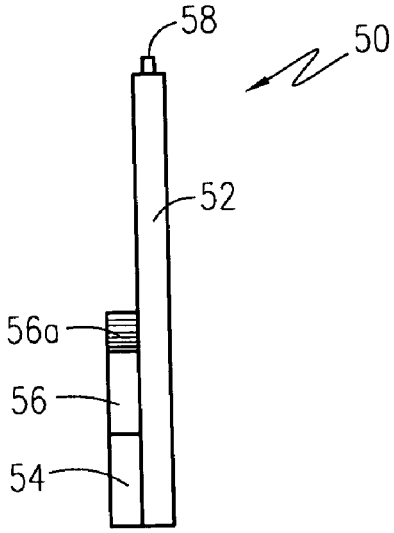
FIG. 5*a* is a side view of the pedestal base element 50 illustrating the ribs 58 and the rounded indentation 56*a* thereon.
Figure 5B:
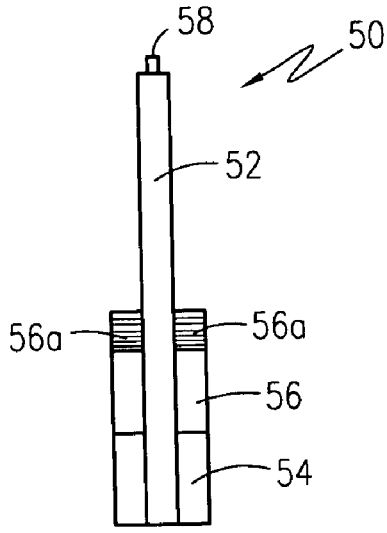
FIG. 5*b* is a side view of the pedestal base element 50 illustrating a pair of horizontal bench supporting elements 56 and a pair of horizontal stabilizing elements 54, and a pair of rounded indentations 56*a* thereon.
Figure 6:
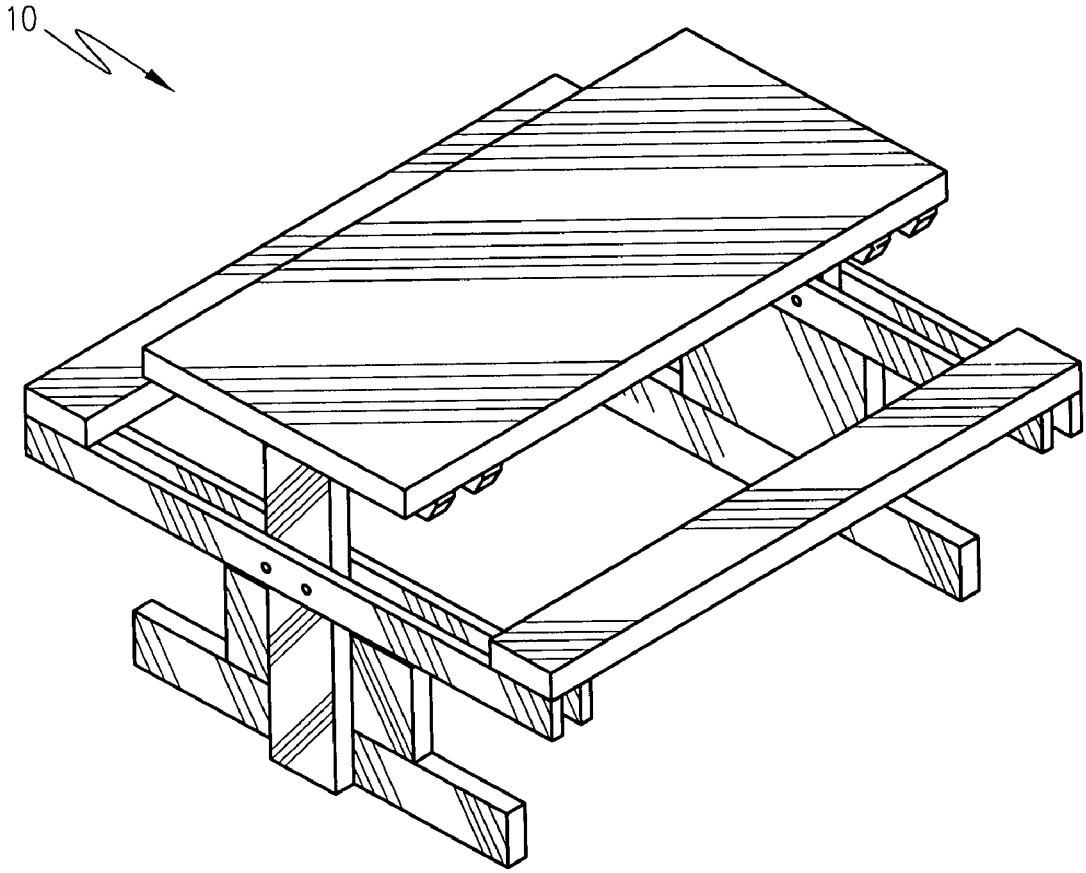
FIG. 6 is a perspective view of a modular picnic table according to the alternative embodiment of the present invention.
Figure 7:
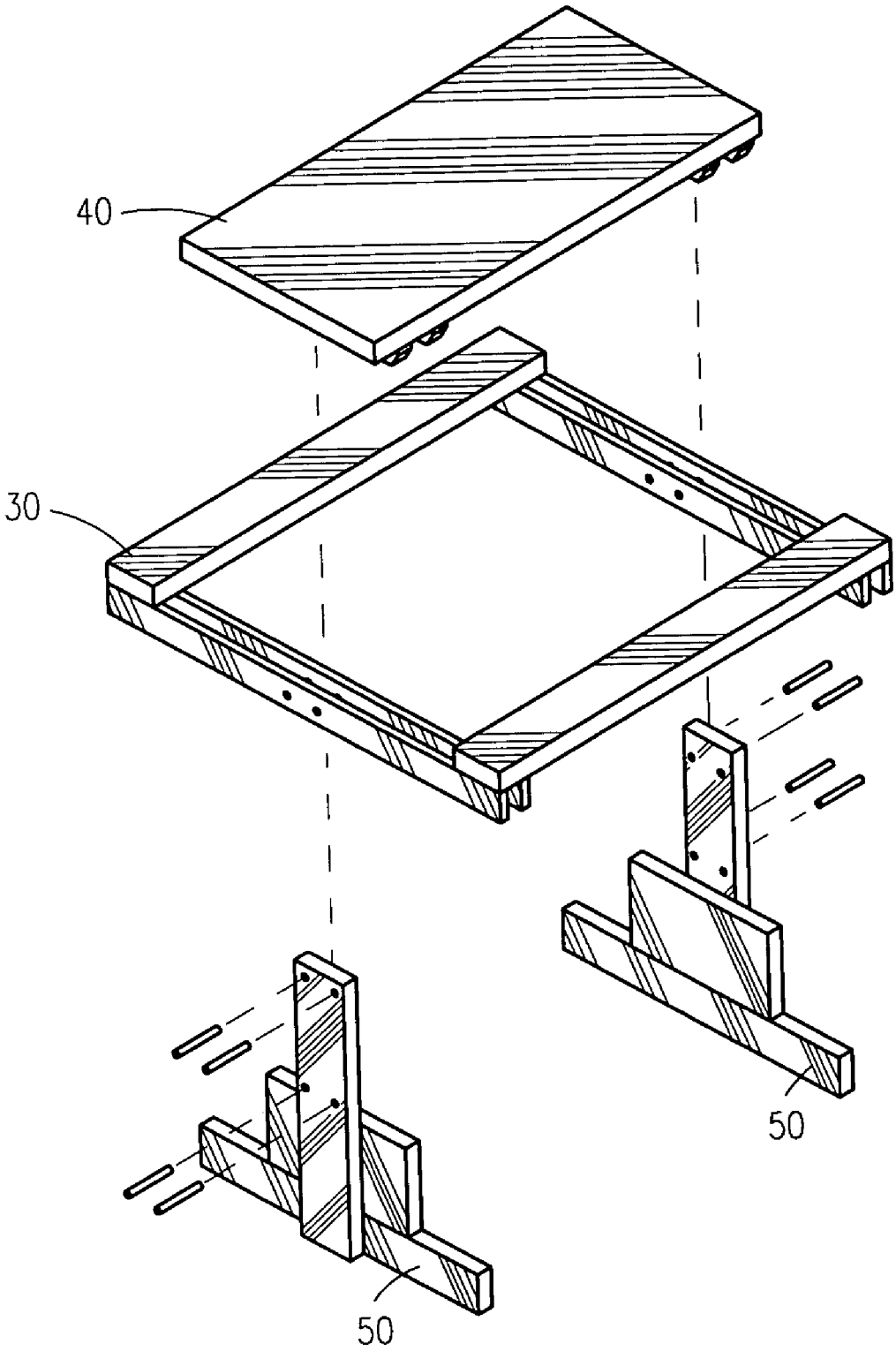
FIG. 7 is an exploded perspective view thereof.
Figure 8A:
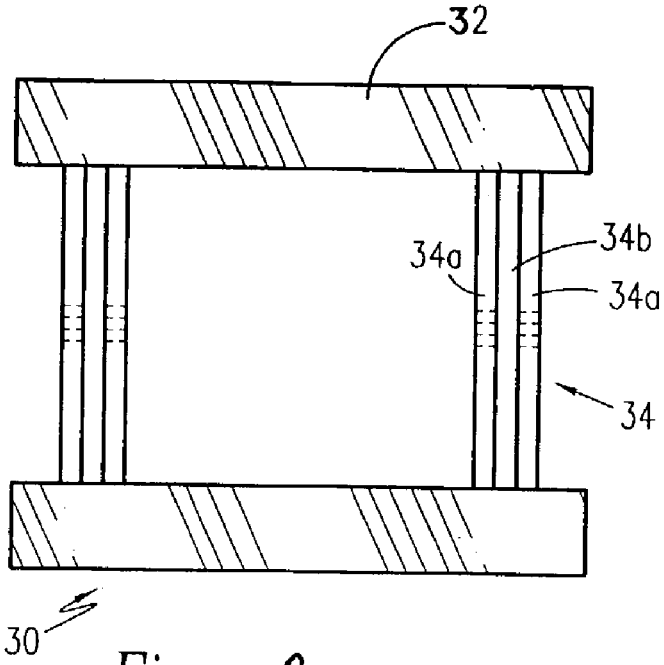
FIG. 8*a* is a top plan view of a dual cantilever bench element 30 for use with the modular picnic table of the present invention.
Figure 8B:
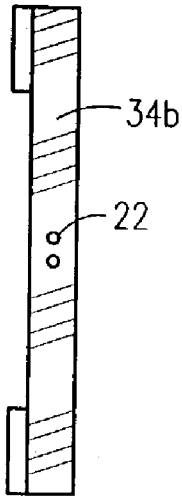
FIG. 8*b* is a side elevational view of the dual cantilever bench element 30 of FIG. 8*a;*

FIG. 4 illustrate a single pedestal base element 50. It is anticipated that two such pedestal base elements 50 will be necessary for use with the present modular picnic table 10. Each pedestal base element 50 has a vertically elongated support column 52 with a top supporting surface 53 opposite a horizontal stabilizing element 54. The horizontal stabilizing element 54 is perpendicularly affixed to the support column 52, and is of sufficient lateral span to allow for sturdy support of the completed picnic table 10. Additionally, a horizontally disposed bench supporting element 56 is affixed to the support column 52 to provide structural support for the bench element 30. In another embodiment, it is envisioned that each pedestal base element 50 will include a pair of horizontal stabilizing elements 54 (first and second horizontal stabilizing elements 54, respectively) and a pair of bench supporting elements 56 (as seen in FIG. 5*b,* first and second bench supporting elements 56 respectively) so as to provide more surface area, and thus, greater structural support to the bench element 30 as it is affixed and is supported by the pedestal base elements 50. In another embodiment, shown in FIG. 10*d,* the top supporting surface 53 departs from the linear embodiment of FIG. 5*a* and includes a substantially wider terminal end (depicted as substantially triangulated in shape). The substantially wider terminal end of the top supporting surface 53 provides greater surface area in contacting the lower surface (underside) of the table top and inserting into the pedestal receiving slot 44*b,* thereby providing greater structural support to the table top 40, but also preventing unnecessary tilting or movement of the table top 40 when items are placed thereon, or when seated users place elbows, arms or generally exert force on the margins of the table top 40. A plurality of ribs 58 are provided to any and/or all of the embodiments of the pedestal base element 50 disclosed. The ribs 58 are vertically projected upward from the top supporting surface 53 and are inserted into corresponding rib orifices 46 formed in the lower surface (underside) of the table top 40.

Referring now to an alternative embodiment of the present invention, FIG. 6 through FIG. 8*b* shows the bench element 30 in greater detail. As shown, a pair of lateral bench slats 32 are mounted parallel to each other and held together in a spaced-apart (offset) manner by a plurality of support stringer assemblies 34 (shown in FIG. 3*a* as a pair of support stringer assemblies). Each support stringer assembly 34 is formed of a pair of individual support stringer members 34*a* separated by a pedestal receiving slot 34*b*. Each bench slat 32 includes a plurality of pin fastener receiving orifices 22, as shown, for accepting pin fasteners 20. Further, a surface of each support stringer member 34*a* includes a plurality of pin fastener receiving orifices 22 for receiving and frictionally impinging the pin fasteners 20. In this manner, the lateral bench slats 32 can be fastened to the support stringer assemblies 34 in a quick and convenient manner, without the aid of additional hand tools (if necessary). Also, as shown in FIG. 3*b,* at the center point of each individual support stringer members 34*a* are additional pin fastener receiving orifices 22 formed for attachment to the pedestals 50 by pin fasteners 20, as will be described in greater detail below.

Figure 9A:
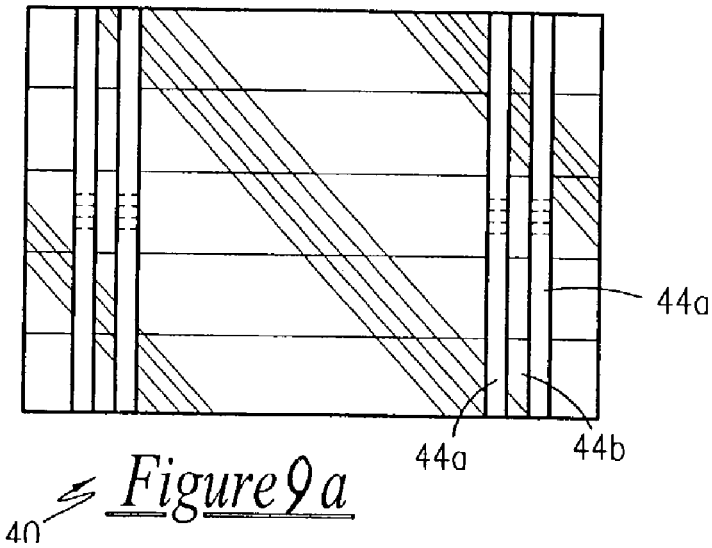
FIG. 9*a* is a bottom plan view of a table top 40 for use with the modular picnic table of the present invention.
Figure 9B:
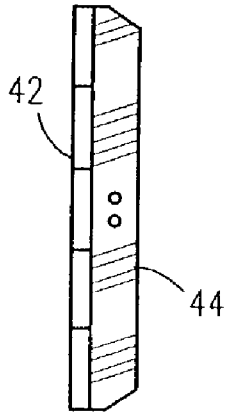
FIG. 9*b* is a side elevational view of the table top 40 of FIG. 9*a;*

FIG. 9*a* and FIG. 9*b* show the table top 40 in greater detail. As shown, the table top 40 has a generally planar upper surface 42. Attached to the lower surface of the table top 40 are a plurality of attachment stringer assemblies 44. A pair of attachment stringer assemblies 44 are mounted parallel to, but on opposing ends, of each other. Each attachment stringer assembly 44 is formed of a pair of individual attachment stringer members 44*a* separated by a pedestal receiving slot 44*b*. It is anticipated that the overall size and dimension and location of these support stringer members 44*a* separated by a pedestal receiving slot 44*b* would be comparable to the support stringer assemblies 34 of the bench element 30, so as to substantially align the support stringer assemblies 34 and the attachment stringer assemblies 44 when the modular picnic table 10 is assembled. Also, and as shown in FIG. 4*b,* at the center point of each individual attachment stringer members 44*a* are a plurality of pin fastener receiving orifices 22 formed for attachment to the pedestals 50 by pin fasteners 20, as will be described in greater detail below.

Figure 10A:
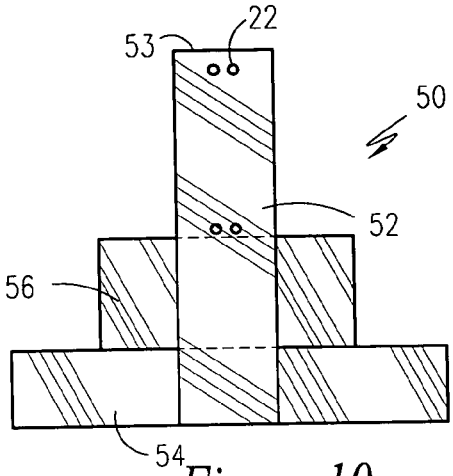
FIG. 10*a* is a side elevational view of a pedestal leg element 50 for use with the modular picnic table of the present invention.
Figure 10B:
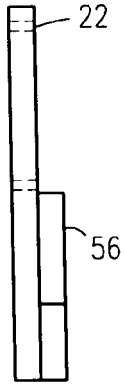
FIG. 10*b* is a side elevational view of the pedestal leg element 50 of FIG. 10*a;*
Figure 10C:
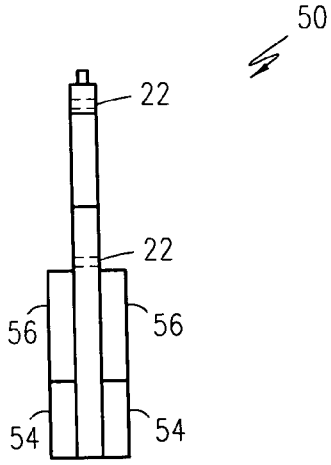
FIG. 10*c* is a side elevational view of the pedestal leg element 50 comprising a pair of horizontal bench supporting elements 56 and a pair of horizontal stabilizing elements 54.
Figure 10D:
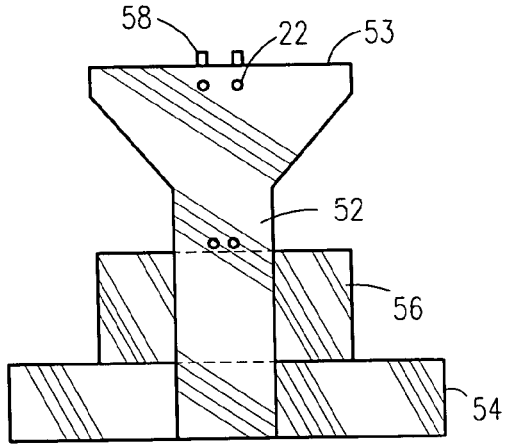
FIG. 10*d* is a front view of an alternative embodiment of the pedestal leg element 50, comprising a triangulated upper support column 52, a wider supporting surface 53, and optionally, a plurality of ribs 58.
Figure 10C:
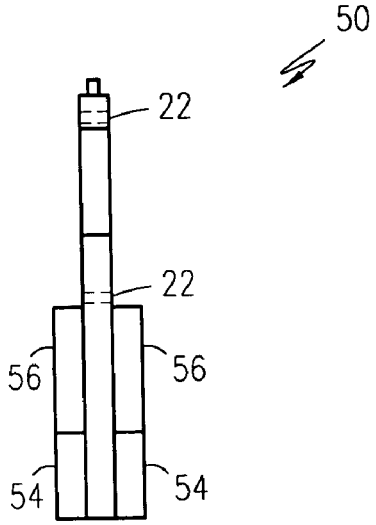
Figure 10D:
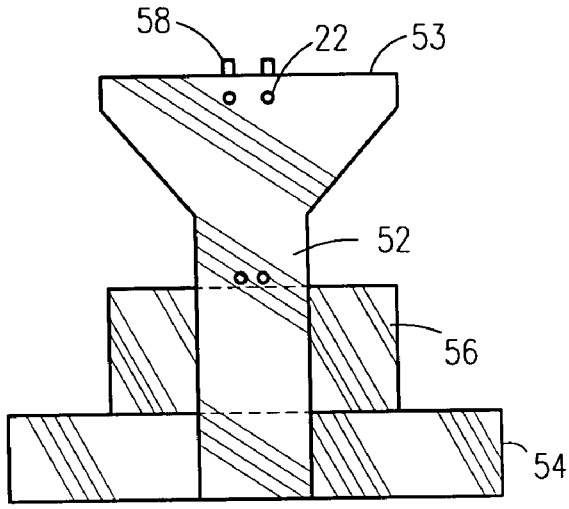

FIG. 10*a,* FIG. 10*b,* FIG. 10*c* and FIG. 10*d* illustrate a single pedestal base element 50. It is anticipated that two such pedestal base elements 50 will be necessary for use with the present modular picnic table 10. Each pedestal base element 50 has a vertically elongated support column 52 with a top supporting surface 53 opposite a horizontal stabilizing element 54. The horizontal stabilizing element 54 is perpendicularly affixed to the support column 52, abutting against the underside of the bench element 30, and is of sufficient lateral span to allow for sturdy support of the completed picnic table 10. Also, at both the top and near the center point of each individual support column 52 are a plurality of pin fastener receiving orifices 22 formed for attachment of both the table top 40 and bench element 30, respectively, to the pedestal base elements 50 by pin fasteners 20, as will be described in greater detail below. In another embodiment, it is envisioned that each pedestal base element 50 will include a pair of horizontal stabilizing elements 54 (first and second horizontal stabilizing elements 54, respectively) and a pair of bench supporting elements 56 (as seen in FIG. 5*c,* first and second bench supporting elements 56, respectively) so as to provide more surface area, and thus, greater structural support to the bench element 30 as it is affixed and is supported by the pedestal base elements 50. In another embodiment, shown in FIG. 10*d,* the top supporting surface 53 departs from the linear embodiment of FIG. 10*a* and includes a substantially wider terminal end (depicted as substantially triangulated in shape). The substantially wider terminal end of the top supporting surface 53 provides greater surface area in contacting the underside of the table top and inserting into the pedestal receiving slot 44*b,* thereby providing greater structural support to the table top 40, but also preventing unnecessary tilting or movement of the table top 40 when items are placed thereon, or when seated users place elbows, arms or generally exert force on the margins of the table top 40.

2. Operation of the Preferred Embodiment

In accordance with a preferred embodiment of the present invention, as shown in FIG. 1*a* through FIG. 5*b,* the modular picnic table 10 is assembled by starting with the four-unit structure (bench element, pair of base pedestals and table top). The pair of base pedestals 50 are aligned about the bench element 30. The support column 52 with ribs 58 is passed through the pedestal receiving slot 34*b*. The protuberances 36*a* are aligned with the indentations 56*a* and frictionally and gravitationally impinged in a substantially interlocking manner. Thus, the pedestal base elements 50 are now freely standing and supporting the bench element 30. Next, the table top 40 is aligned so that the rib receiving orifices 46 insertably receive the corresponding ribs 58 from the top supporting surface 53. The ribs 58 frictionally and gravitationally impinge therein, thus the entire modular picnic table 10 is now assembled and ready for reliable use. To disassemble, simply reverse the assembly procedure.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A modular picnic table comprising:

a pair of pedestal base elements, each of said pair of pedestal base elements comprising a vertically elongated support column, a first horizontal stabilizing element mounted perpendicular to said support column and resting on a surface, and a first horizontally disposed bench supporting element mounted perpendicular to said support column and adjacent to said stabilizing element;

a dual cantilevered bench element comprising a pair of lateral bench slats mounted parallel to one another and secured in an offset manner by a plurality of support stringer assemblies, wherein said dual cantilevered bench element is connected to said pair of pedestal base elements via a plurality of support stringer assemblies, thereby supporting said bench element; and a table top comprising an upper surface opposite a lower surface, a plurality of attachment stringer assemblies affixed to said lower surface, one of said support columns inserted between one of said plurality of attachment stringer assemblies, said remaining one of said support columns inserted between remaining one of said plurality of attachment stringer assemblies, wherein said support columns support said table top.

2. The table of claim 1, wherein said support column comprises a plurality of ribs vertically projected upward from a top supporting surface and inserted into said lower surface, said plurality of ribs frictionally impinged within corresponding plurality of rib receiving orifices formed in said lower surface.

3. The table of claim 1, wherein said support column comprises a triangulated terminal end, said triangulated terminal end providing greater surface area to contact said lower surface and impart greater structural support.

4. The table of claim 1, wherein each one of said plurality of support stringer assemblies comprise a pair of individual support stringer members aligned in a parallel manner and defining a pedestal receiving slot therebetween, thereby permitting penetration of said support column therethrough.

5. The table of claim 4, wherein at least one of each pair of individual support stringer members comprises a pair of protuberances frictionally and gravitationally impinged with a corresponding pair of indentations formed on said bench supporting element.

6. The table of claim 4, wherein at least one of each pair of individual support stringer members abuts said bench supporting element.

7. The table of claim 1, wherein each one of said plurality of attachment stringer assemblies comprise a pair of individual attachment stringer members aligned in a parallel manner and defining a pedestal receiving slot therebetween, thereby permitting insertion of said support column therein to support said table top.

8. The table of claim 1 further comprising:

a second horizontal stabilizing element mounted perpendicular to said support and on an opposite side to said first horizontal stabilizing element, said second stabilizing element resting on said surface parallel to said first stabilizing element; and a second bench supporting element mounted to said support column and on an opposite side to said first bench supporting element, said second bench supporting element mounted adjacent to said second horizontal stabilizing element.

9. The table of claim 8, wherein each one of said first bench supporting element and said second bench supporting element comprise a pair of indentations for receiving a corresponding pair of protuberances formed on underside of said support stringer assemblies, said pair of protuberances frictionally and gravitationally impinged within said pair of indentations.

10. The table of claim 1 further comprising a plurality of pin fastener orifices for receiving corresponding pin fasteners to frictionally impinge said pair of pedestal base elements to said bench element and said table top.

11. The table of claim 10, wherein each one of said pair of pedestal base elements comprise two pairs of pin fastener orifices formed on said support column, a first pair aligning with a pair of pin fastener orifices formed on said plurality of support stringer assemblies, and a second pair aligning with a pair of pin fastener orifices formed on said plurality of attachment stringer assemblies.

12. The table of claim 10, wherein each one of said plurality of support stringer assemblies comprise a pair of individual support stringer members aligned in a parallel manner and defining a pedestal receiving slot therebetween, thereby permitting penetration of said support column therethrough.

13. The table of claim 10, wherein at least one of each pair of individual support stringer members abuts said bench supporting element.

14. The table of claim 10, wherein each one of said plurality of attachment stringer assemblies comprise a pair of individual attachment stringer members aligned in a parallel manner and defining a pedestal receiving slot therebetween, thereby permitting insertion of said support column therein to support said table top.

15. The table of claim 10, further comprising:

a second horizontal stabilizing element mounted perpendicular to said support and on an opposite side to said first horizontal stabilizing element, said second stabilizing element resting on said surface parallel to said first stabilizing element; and a second bench supporting element mounted to said support column and on an opposite side to said first bench supporting element, said second bench supporting element mounted adjacent to said second horizontal stabilizing element.

* * * * *